US009718584B2

(12) United States Patent
Bohager

(10) Patent No.: US 9,718,584 B2
(45) Date of Patent: Aug. 1, 2017

(54) MULTI-PURPOSE CONTAINER SYSTEM

(71) Applicant: Daniel J. Bohager, Hampstead, MD (US)

(72) Inventor: Daniel J. Bohager, Hampstead, MD (US)

( * ) Notice: Subject to any disclaimer, the term of this patent is extended or adjusted under 35 U.S.C. 154(b) by 29 days.

(21) Appl. No.: 14/881,719

(22) Filed: Oct. 13, 2015

(65) Prior Publication Data

US 2017/0101221 A1 Apr. 13, 2017

(51) Int. Cl.
*B65D 25/24* (2006.01)
*B65D 21/02* (2006.01)
*B65D 25/28* (2006.01)

(52) U.S. Cl.
CPC ..... *B65D 25/24* (2013.01); *B65D 21/0233* (2013.01); *B65D 25/2873* (2013.01)

(58) Field of Classification Search
CPC B65D 25/24; B65D 25/2873; B65D 21/0209; B65D 21/0212; B65D 21/0213; B65D 21/023
USPC ..... 220/629, 23.6, 23.83, 504, 4.22, 4.23, 220/4.27; 206/501, 503, 509, 512
See application file for complete search history.

(56) References Cited

U.S. PATENT DOCUMENTS 1,142,587 A 6/1915 Ledbetter
1,801,055 A * 4/1931 Roos ..... B44C 7/04 220/629
2,665,098 A 1/1954 Oden
3,117,692 A * 1/1964 Carpenter ..... B65D 21/0219 206/501
4,392,662 A 7/1983 Hoglinger
5,056,878 A 10/1991 Givens
5,295,365 A 3/1994 Redford
5,456,357 A 10/1995 Wenner et al.
5,480,170 A 1/1996 Kaiser, II
5,566,530 A 10/1996 Johnstone et al.
6,776,379 B2 8/2004 Sherer et al.
7,341,164 B2 * 3/2008 Barquist ..... F16M 11/32 220/592.03
8,899,435 B1 12/2014 Reder et al.
2011/0079687 A1 * 4/2011 Grove ..... F16M 11/08 248/168
2014/0014653 A1 * 1/2014 Roesler ..... B65D 21/0226 220/23.6

* cited by examiner

*Primary Examiner* — Fenn Mathew
*Assistant Examiner* — Don M Anderson
(74) *Attorney, Agent, or Firm* — H. Jay Spiegel

(57) ABSTRACT

A multi-purpose container system includes a first container that has attached to it opposed pairs of legs. Each pair of legs may pivot from a first position to a second position rotated about 180 degrees. In the second position of the legs, the first container may be supported inverted with its opening facing downward. In that orientation, a recessed area is facing upward and has a periphery sized to receive a second container. The second container may be placed with its bottom edges received within the recessed area to support the second container. In that orientation, the second container is significantly elevated from a floor surface. Thus, tools and supplies may be stored within the second container elevated off the floor allowing a workman easy access to the interior of the second container to retrieve tools and supplies while performing work.

18 Claims, 10 Drawing Sheets

MULTI-PURPOSE CONTAINER SYSTEM

BACKGROUND OF THE INVENTION

The present invention relates to a multi-purpose container system. Various repairmen and handymen have to carry a large amount of tools and other supplies with them when they go to a job to perform installations and/or repairs. Typically, they place a container containing the supplies and tools on a floor surface. In that location, they are required to bend over to retrieve tools and supplies dozens upon dozens of times when performing a job. These actions can cause severe strain on the back, knees and shoulders of the person. As such, there is a need for a device that permits a repair person, handyman, HVAC expert, or installer to carry tools and supplies easily while at the same time being able to position the container during performing of work at a convenient elevation to preclude injury, soreness, and inconvenience to them while they perform their services. It is with these needs in mind that the present invention was developed.

Applicant is aware of the following prior art:

| |
|---|
| 4,392,662 to Höglinger |
| 5,056,878 to Givens |
| 5,295,365 to Redford |
| 5,480,170 to Kaiser, II |
| 5,566,530 to Johnstone et al. |
| 6,776,379 to Sherer et al. |
| 7,341,164 to Barquist et al. |

Each of these patents teaches a container of some kind or another that includes legs that are extendable and retractable. However, none of these references teaches or suggests such legs that are invertible to support a container in either of two orientations with one of the orientations allowing a second container to be supported on the first container to elevate it off a floor surface.

SUMMARY OF THE INVENTION

The present invention relates to a multi-purpose container system. The present invention includes the following interrelated objects, aspects and features:

(1) The present invention includes a first container that may be a bucket-type container that has attached to it opposed pairs of legs. The legs may extend and retract either through the use of hinges or telescoping structure. Each pair of legs is mounted to the first container via a hinge allowing the legs to pivot from a first position to a second position rotated about 180 degrees with respect to the first position.

(2) The legs may be retained in either orientation by any suitable means such as recesses in edges of the first container receiving the peripheries of the legs through an interference fit, an elastic cord such as a bungee cord placed around the periphery of the container or connected between the legs, or any other suitable means.

(3) In the second position of the legs, the first container may be supported inverted with its opening facing downward. In that orientation, a recessed area is facing upward and has a periphery sized to snugly receive a second container. The second container may be placed with its bottom edges received within the recessed area to support the second container and prevent it from accidentally falling out of the recess.

(4) In that orientation, the second container is elevated from a floor surface by the height of the legs as well as the height of the first container less the height of the recess. In this way, the second container can be elevated above a floor surface by a distance of at least 24 to 36 inches. Thus, tools and supplies may be stored within the second container elevated off the floor by the first container and the legs in a manner allowing the workman easy access to the interior of the second container to be able to retrieve tools and supplies while performing work.

As such, it is a first object of the present invention to provide a multi-purpose container system.

It is a further object of the present invention to provide such a container in which a first container receives a second container in either one of two orientations.

It is a yet further object of the present invention to provide such a container in which legs are attached to a first container and may pivot between two orientations spaced 180 degrees apart.

It is a still further object of the present invention to provide such a container in which with the legs in a second position thereof the first container is inverted allowing a second container to be supported thereon.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
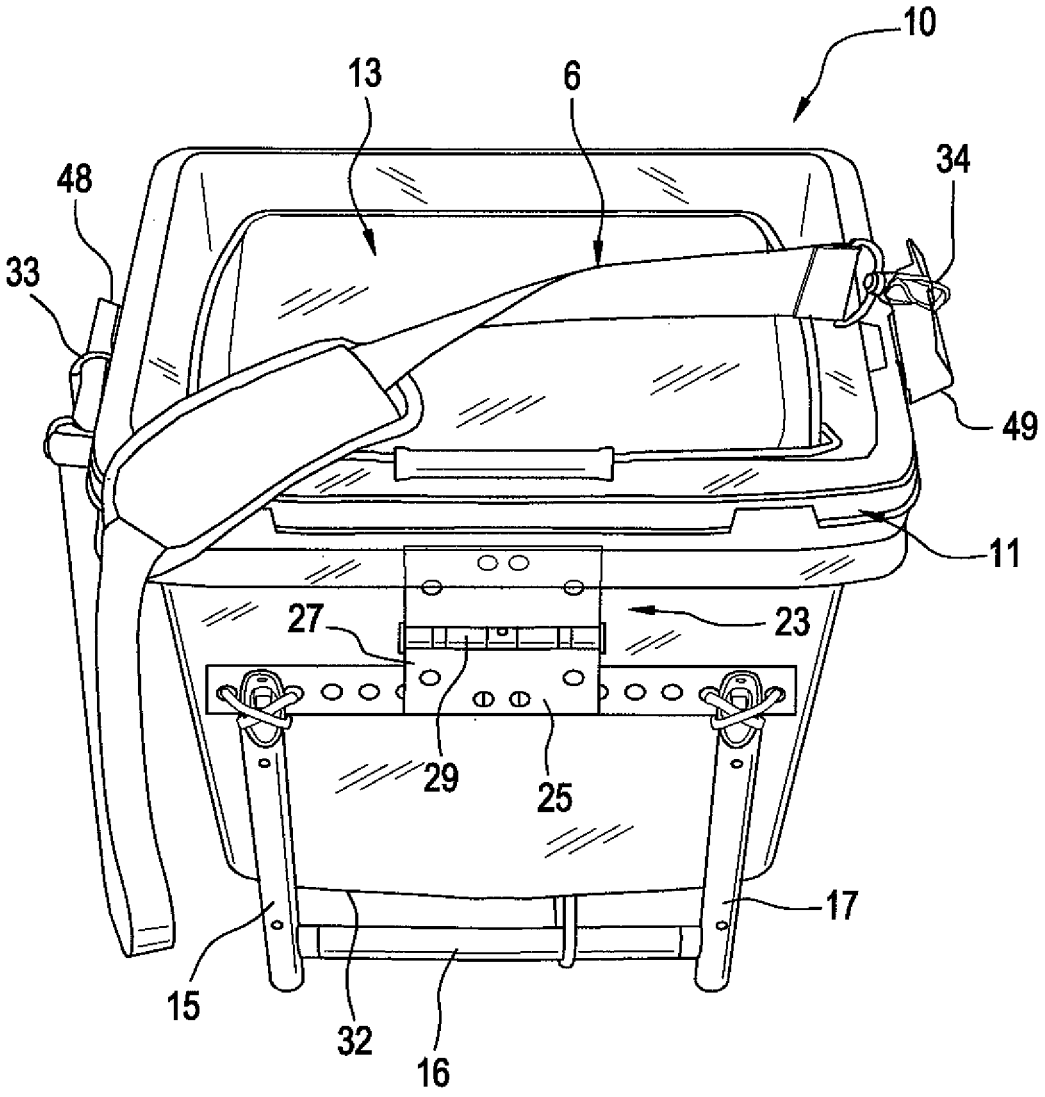
FIG. 1 shows a side top perspective view of the present invention in a first orientation thereof.

With reference, first, to FIG. 1, the present invention is generally designated by the reference numeral 10 and includes a first container 11 and a second container 13. The first container has a first support comprising a pair of legs 15, 17 and a second support comprising a pair of legs 19 and 21 best seen in FIGS. 4 and 7.

The legs 15 and 17 are mounted in a parallel relationship with respect to one another with a cross member 16 interconnecting them and are attached to a hinge 23 that includes a first plate 25 to which the legs 15 and 17 are attached, a second plate 27 attached to the container 11, and the hinge area 29 interconnecting the plates and allowing the plates to pivot 180 degrees with respect to one another. Thus, comparing FIGS. 1 and 4, it is seen that the legs 15 and 17 in FIG. 1 are oriented in a first orientation and in FIG. 4 are pivoted 180 degrees to a second orientation. The same first and second orientations are available for the legs 19 and 21 which are shown in the second orientation in FIG. 4 and are related to a hinge the same or similar to the hinge 23 (as seen through the translucent container 11 in FIG. 3). The hinges are mounted on the first container 11 adjacent the opening of its chamber 18. As understood from FIG. 1, the legs 15, 17, 19, 20 extend downward with the container 11 in the orientation shown slightly below the edge 32 of the first container.

Figure 7:
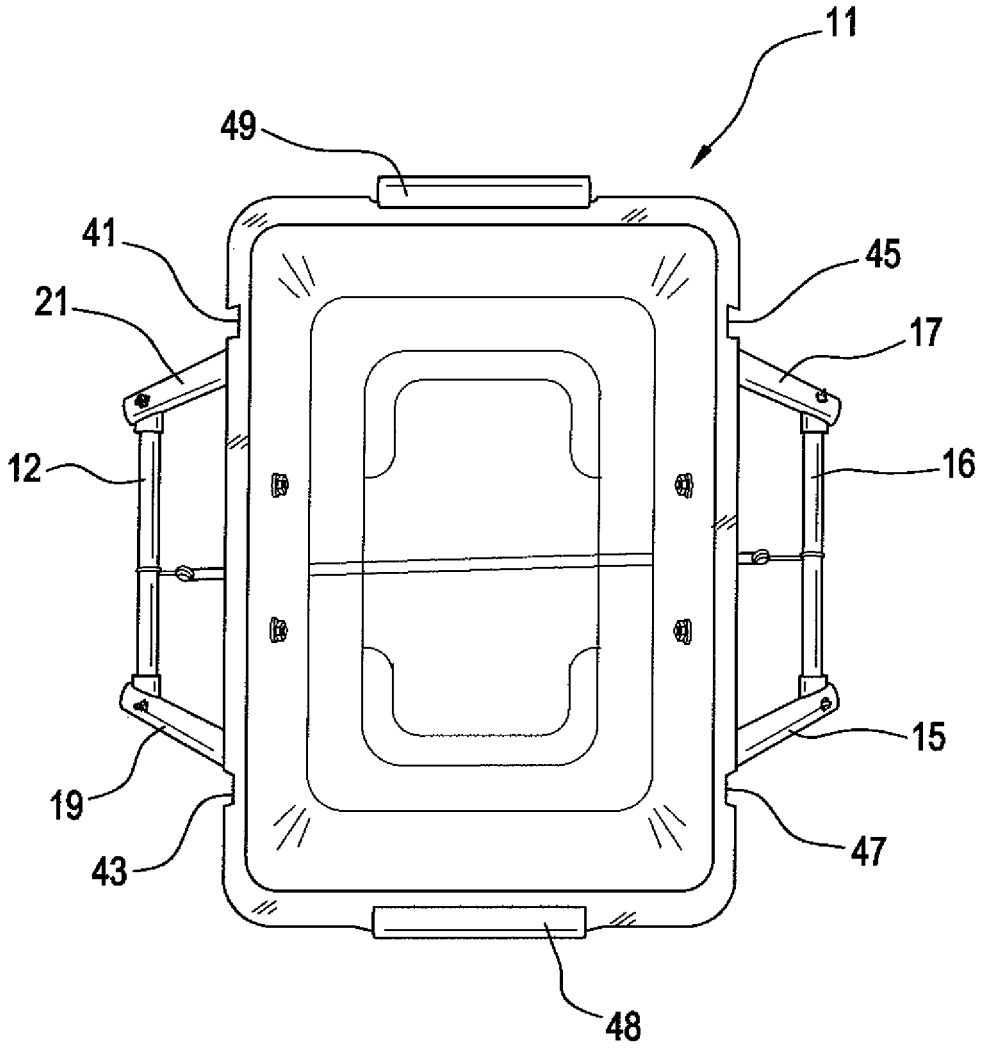
FIG. 7 shows a top view of the first container in the first orientation thereof showing both pairs of legs extending outwardly for better understanding.

FIG. 7 shows the legs 15, 17, 19 and 21 on the container 11 as well as the cross members 12 and 16.

Figure 9:
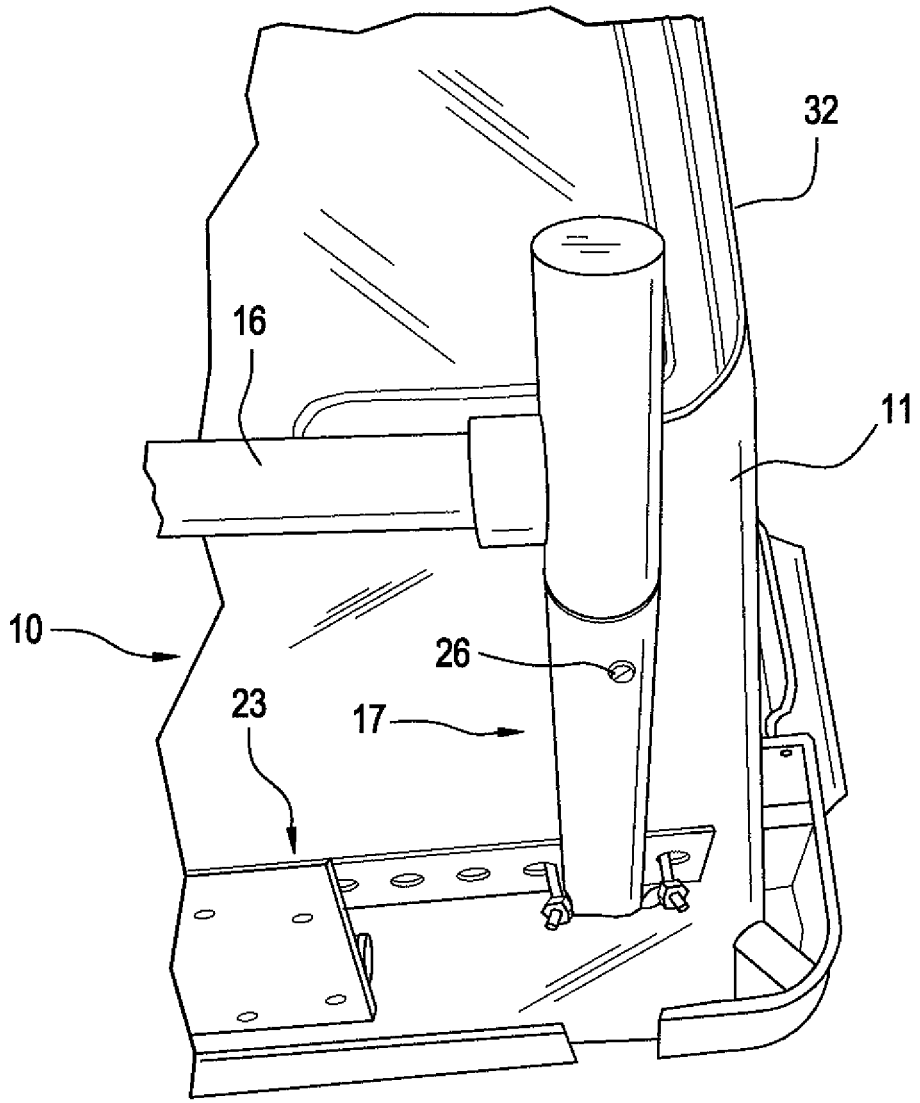
FIG. 9 shows one of the telescoping legs retracted.
Figure 10:
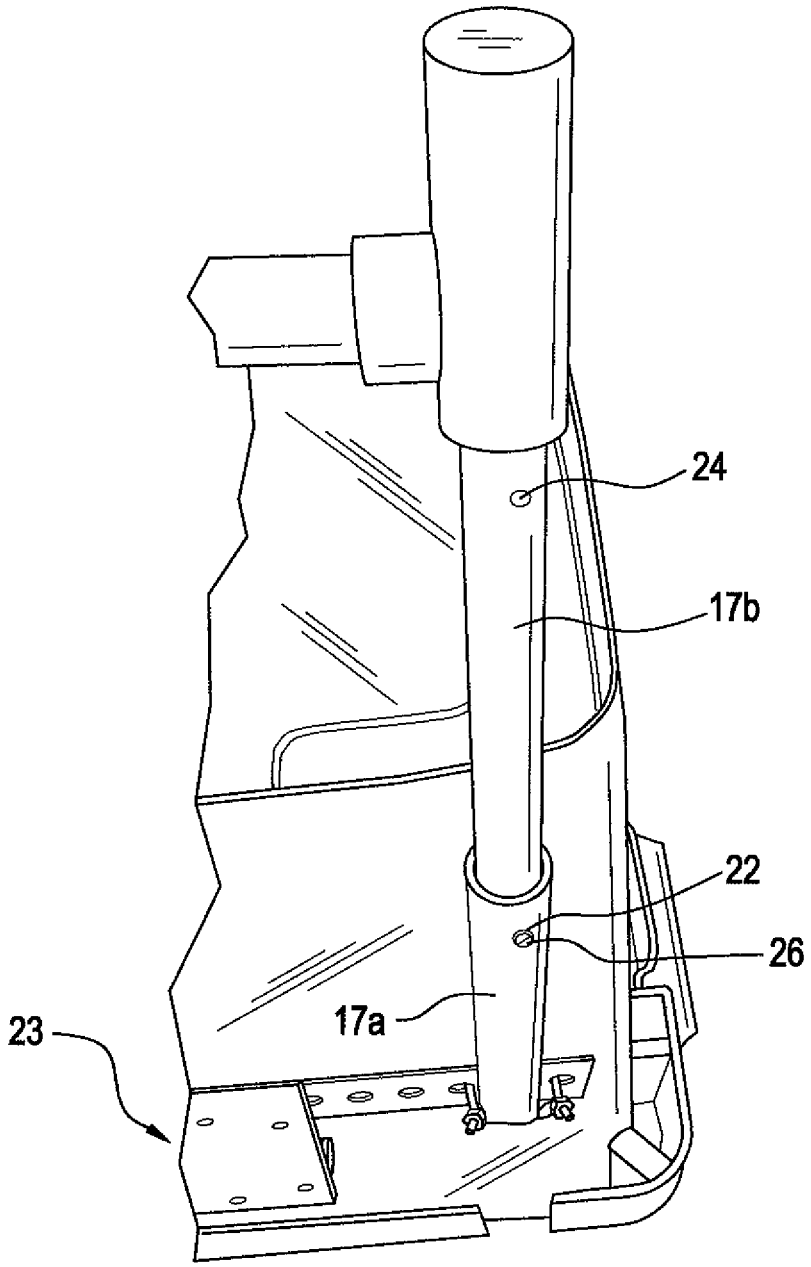
FIG. 10 shows one of the telescoping legs extended.

The legs 15, 17, 19 and 21 may be telescoping as seen in FIGS. 9-10. As shown with the exemplary leg 17, it has section 17*a* attached to hinge 23 and section 17*b* that telescopes within section 17*a*. With reference to FIGS. 9 and 10, holes such as hole 24 align with hole 22 and a pin or screw 26 is inserted into aligned holes to lock the leg 17 in extended (FIG. 10) or retracted (FIG. 9) orientation.

Figure 2:
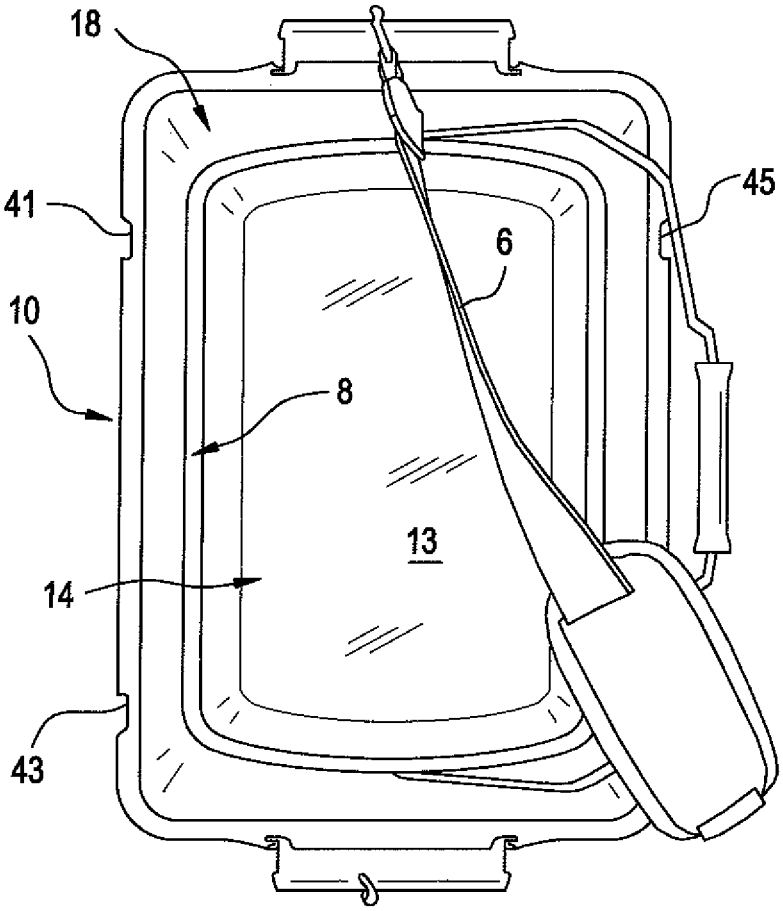
FIG. 2 shows a top view of the first orientation of the present invention.

As shown in FIGS. 1 and 2, the second container 13 has an outer periphery 8 sized and configured fit within the chamber 18 formed by the first container 11. The second container 13 also has an internal chamber 14 which may be used to store tools, supplies, and other items.

The legs 15, 17, 19 and 21 may retract to allow the bottom surface 32 of the first container (consisting of the edge 32) to be slightly spaced above a floor surface as shown in FIG. 1 or, alternatively, to be extended when the container 11 is inverted with the edge 32 facing upward (see FIG. 3) to allow the bottom surface 32 to be further spaced from a floor surface. The location of the hinges adjacent the opening of the chamber 18 of the container 11 results in the container being elevated above a floor surface to a greater extent when inverted than it is with its opening facing upward. See FIGS. 1 and 3. In the first orientation of the present invention 10 seen in FIGS. 1 and 2, the first container may be supported with the opening of its chamber 18 facing upwardly in any one of plural elevations.

Figure 3:
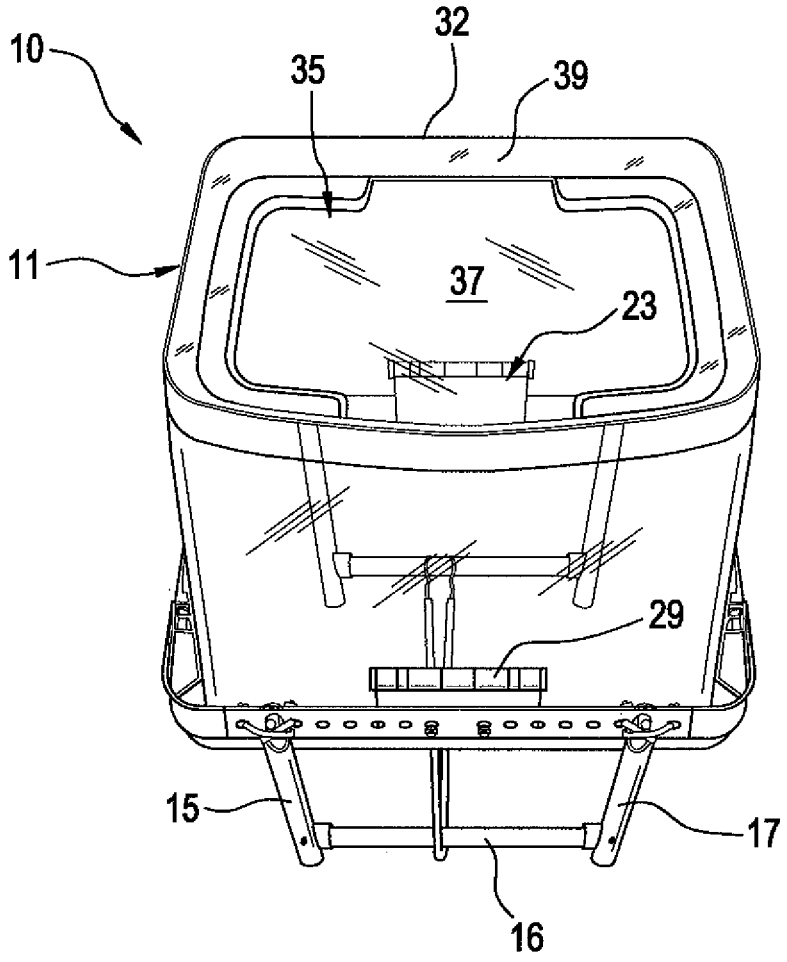
FIG. 3 shows a front top perspective view of the present invention in a second mode thereof with the legs inverted from their orientation in FIGS. 1 and 2.
Figure 4:
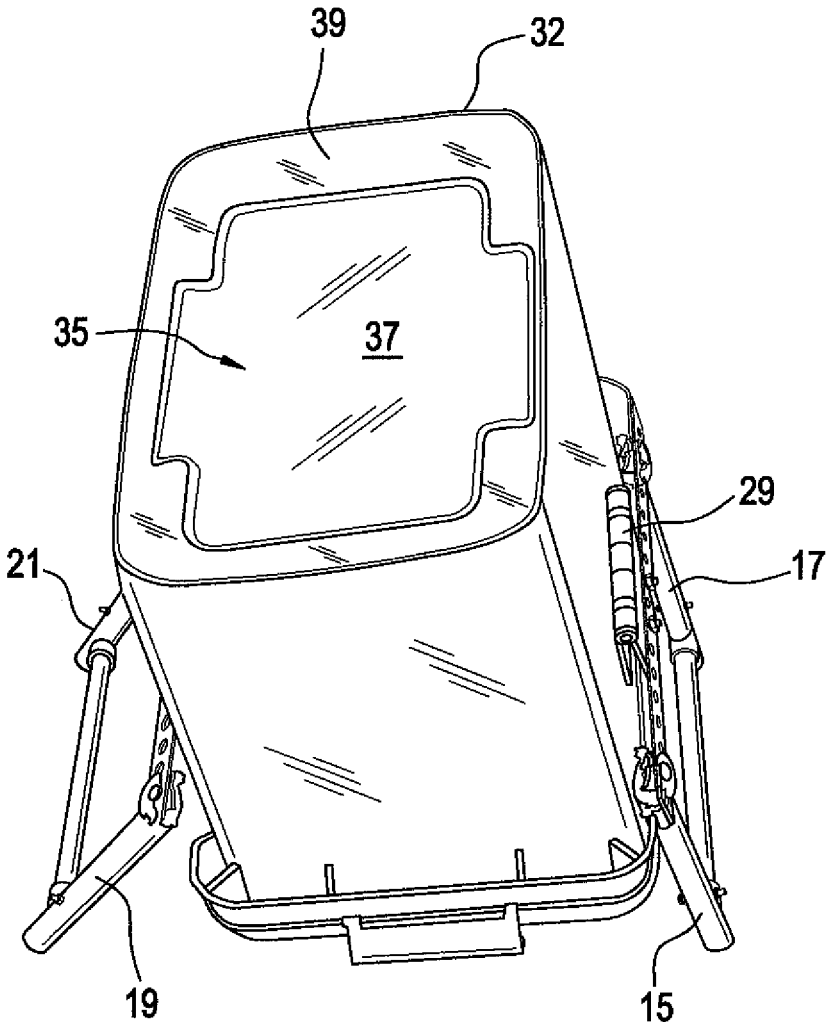
FIG. 4 shows a side perspective view of the orientation of FIG. 3.

When it is desired to place the device 10 in its second orientation, the hinges 23 are operated to pivot the legs from the position shown in FIG. 1 to the position shown in FIG. 3, whereupon the first container 11 may be inverted so that a recessed area 35 (FIG. 3) is now facing upwardly. The recessed area 35 is formed by a wall 37 which is actually the bottom of the container 11 in the orientation of FIGS. 1 and 2, and the peripheral wall 39 with the edge 32 for a purpose to be described hereinafter.

As seen in FIG. 7, the container 11 may have cut-outs 41, 43, 45, and 47 in its upper peripheral lip 42 which are designed to provide an interference fit for the legs when they are pivoted to the position shown in FIGS. 3-6, to allow releasable locking of the legs in that orientation.

Figure 5:
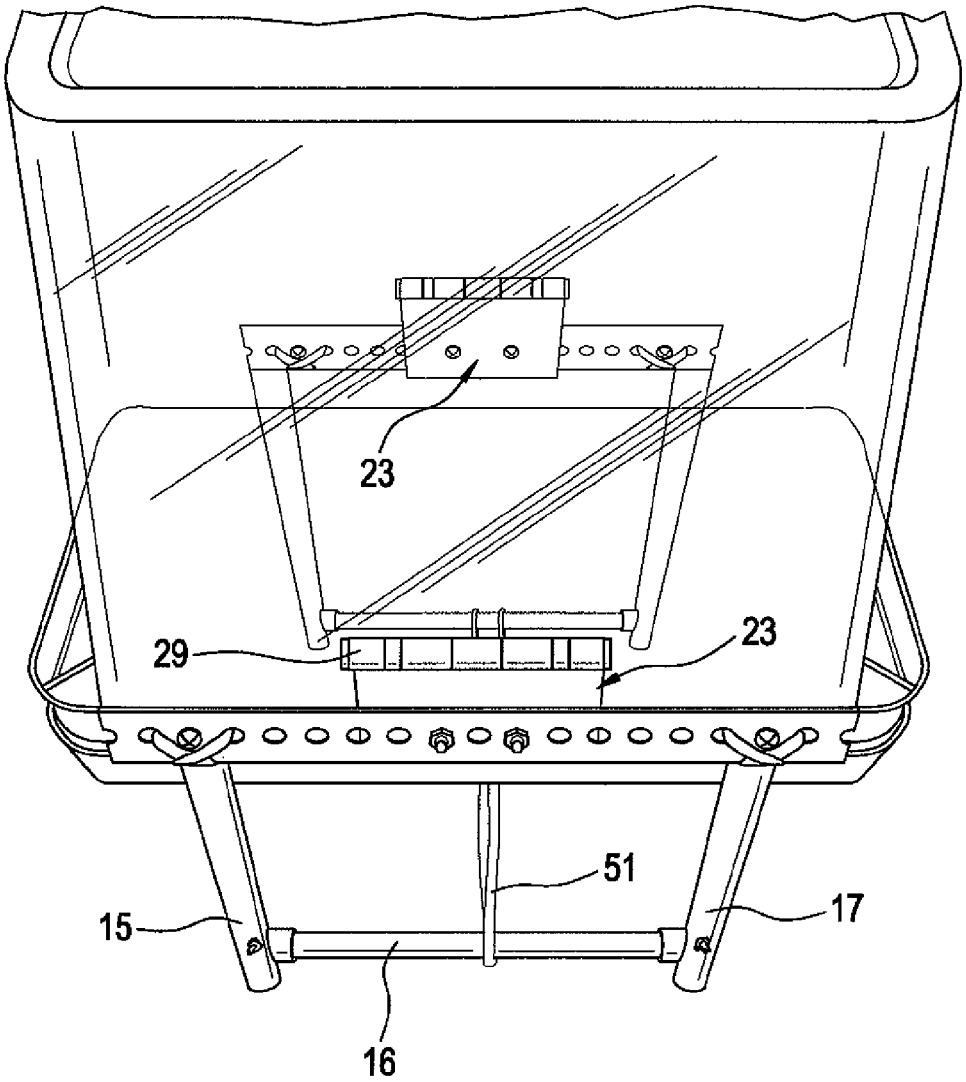
FIG. 5 shows a close-up front view of the orientation of FIGS. 3 and 4 showing the hinge structure for the legs.

With reference to FIG. 5, it is seen that the hinge 23 has its plate 25 pivoted 180 degrees from its orientation as shown in FIG. 1. The same is true of the hinge 23 on the opposite face of the container 11 which supports the legs 19 and 21 as seen in FIGS. 4, 5 and 7, for example.

Figure 6:
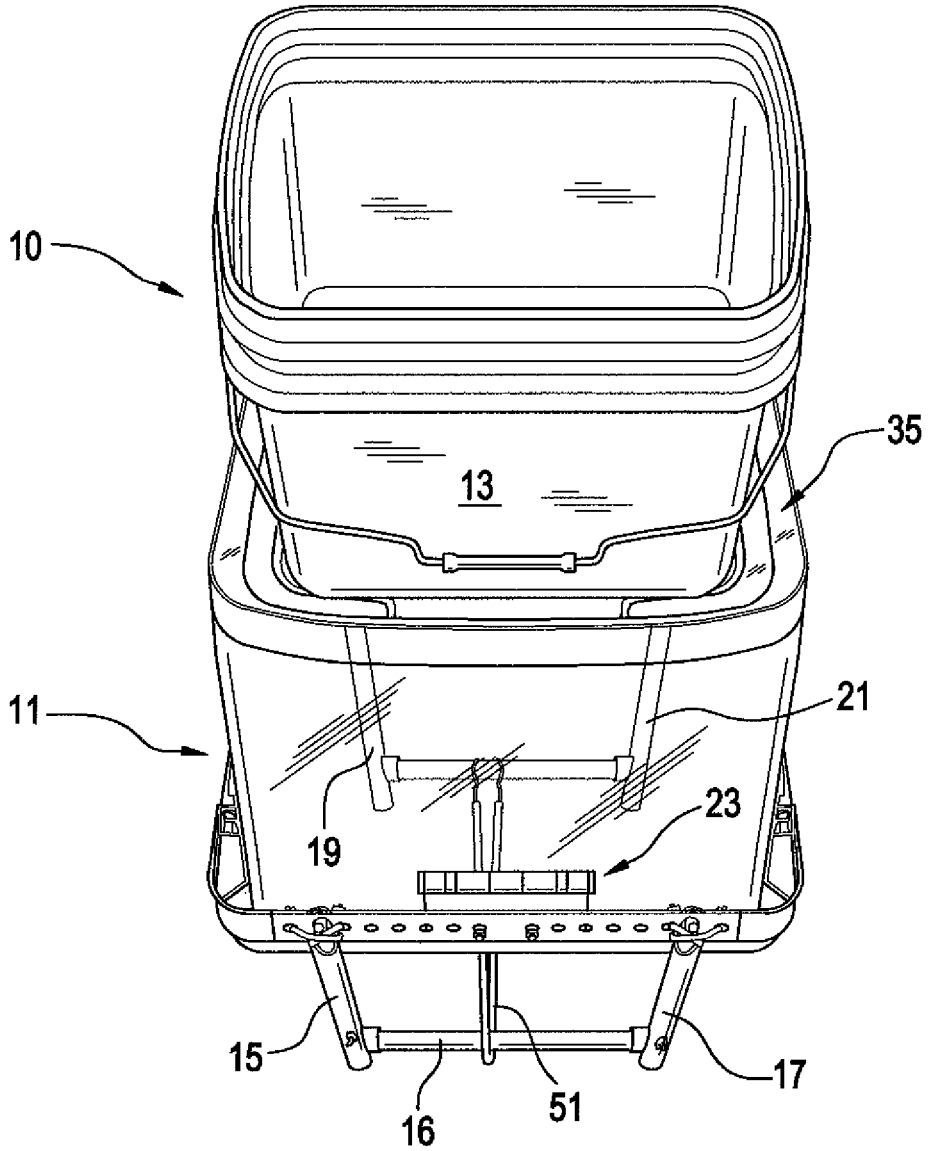
FIG. 6 shows a front top perspective view of the present invention in a second mode thereof with a second container placed on the first container.

With reference to FIG. 6, the second container 13 is shown placed within the recess 35 in the first container 11, and the legs 15 and 17 shown as well as the legs 19 and 21, seen in FIG. 6 through the translucent container 11, support the first container 11 spaced above a ground surface 1, and the second container 13 sits in the recess 35 on top of the first container 11 further spaced from the ground surface 1. In this way, the second container 13 may contain tools, supplies and other items elevated from the ground surface 1 a significant distance so that a workman working on a job can easily reach into the second container 13 to retrieve tools, supplies and other items without having to bend over and reach those items near the ground surface.

The present invention comprises a portable, lightweight carrier that allows several options for elevating a tool and supply receiving container above a ground surface to assist a workman in retrieving things contained therein. Additionally, by elevating the first and second containers above the floor surface, this reduces the possibility that the containers or their contents will become wet or dirty from liquid or debris encountered on the floor surface where the containers are to be situated. This also precludes the floor surface, whether carpeted, hardwood, ceramic, stone or otherwise, from being soiled or marred by the inventive container. In most configurations, the only things touching the floor surface are the ends of the legs which may easily be wiped clean before they engage the floor surface.

Figure 8:
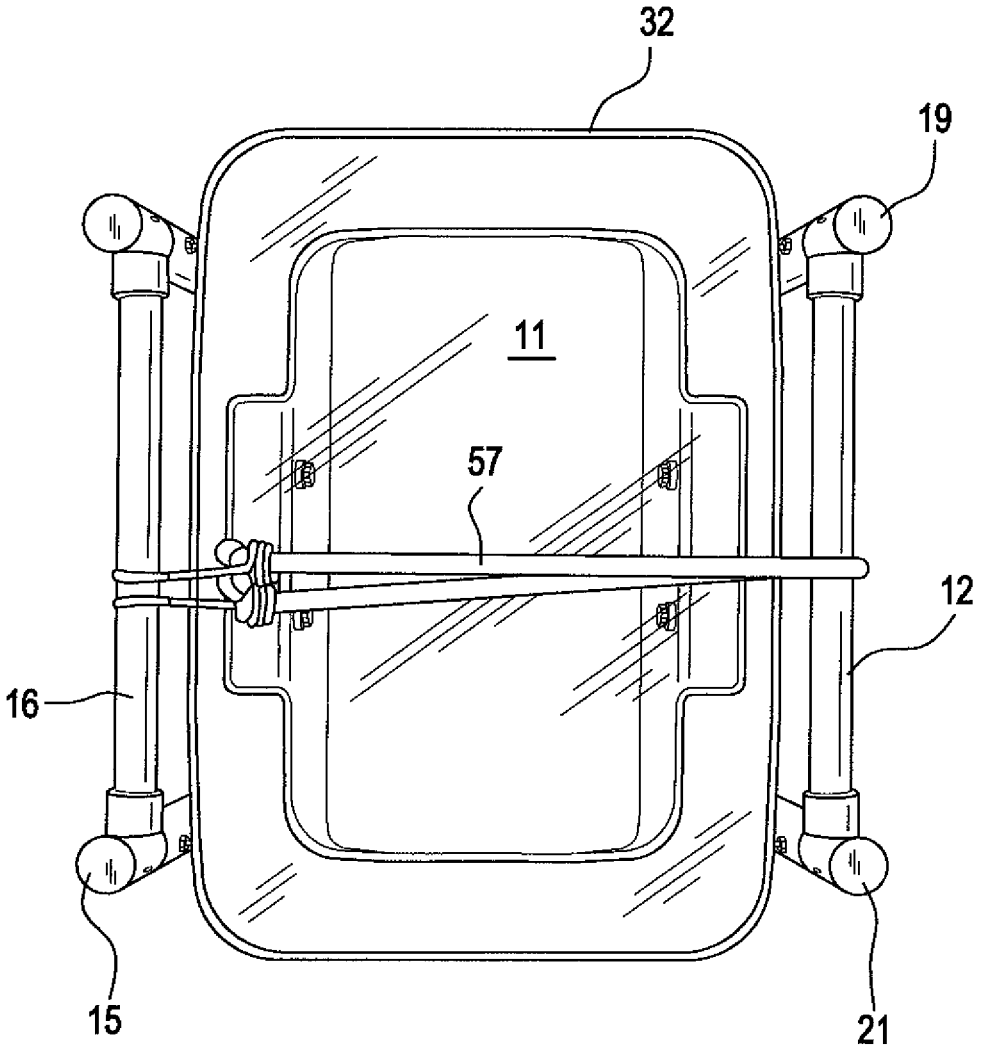
FIG. 8 shows a view looking up from underneath the first container in its first orientation.

If desired, a strap 6 may be releasably attached to the first container 11 (FIG. 1) at clips 33, 34 attached through holes in clasps 48, 49 to allow carrying the device 10 with the strap over the shoulder of the user or in the user's hand. A bungee or elastic cord 51 (FIG. 8) may be used to hold the pivotable legs in either of their opposed pivoted orientations and includes a hook at each end.

The containers and supports may be made of plastic, wood or metal. The strap may be made of cloth, leather or plastic.

Additionally, if desired, a portable shelf (not shown) can easily be removably affixed to one or the other of the containers to allow an additional support for tools, supplies, and other items.

Through use of the present invention, tools, supplies and other items are rendered easily accessible to a workman at a job site, they are easily transportable, and the workman can access the tools, supplies, and other items without straining their back, joints, or other body parts.

As such, an invention has been disclosed in terms of preferred embodiments thereof which fulfill each and every one of the objects of the invention as set forth hereinabove, and provide a new and useful multi-purpose container system of great novelty and utility.

Of course, various changes, alterations and modifications of the present invention may be contemplated by those skilled in the art without departing from the intended spirit and scope thereof.

As such, it is intended that the present invention only be limited by the terms of the appended claims.

The invention claimed is:

1. A multi-purpose container system, comprising:

a) a container having a bottom and side walls surrounding a chamber having an opening opposite said bottom;

b) a first hinge attached to said container and to which is fastened a first support for said container;

c) a second hinge attached to said container and to which is fastened a second support for said container;

d) said hinges permitting said supports to pivot about 180° with respect to said container;

e) whereby in a first orientation of said supports, said container may be supported with said opening facing upward, and in a second orientation of said supports said container may be supported by said supports with said opening facing downward;

f) further wherein in said second orientation, said bottom of said container faces upward, and further including a peripheral wall surrounding said bottom, said peripheral wall extending upwardly in said second orientation and forming a recessed area with said bottom; and g) further wherein said container comprises a first container, said system comprising a second container having a bottom and side walls surrounding a chamber having an opening opposite said bottom, said second container being sized so that its bottom and adjacent portions of its side walls are closely receivable within said recessed area in said second orientation of said first container.

2. The system of claim 1, wherein said supports comprise legs.

3. The system of claim 2, wherein each support includes two legs.

4. The system of claim 3, wherein each leg has an adjustable length.

5. The system of claim 4, wherein each leg includes at least two leg sections that telescope to adjust length.

6. The system of claim 3, further including a cross member connected between respective legs of each support.

7. The system of claim 6, further including a cord releasably connectable between said cross members in each orientation of said supports to retain said supports in each orientation.

8. The system of claim 7, wherein said cord comprises an elastic cord including a hook at each end thereof.

9. The system of claim 1, further including a strap releasably attachable to said container.

10. The system of claim 1, wherein said second container includes a handle.

11. The system of claim 1, further including a strap releasably attachable to said container.

12. The system of claim 9, wherein said strap is connected between opposed sides of said first container.

13. The system of claim 1, wherein said containers are made of plastic.

14. A multi-purpose container system, comprising:

a) a first container having a bottom and side walls surrounding a chamber having an opening opposite said bottom;

b) a first hinge attached to said container and to which is fastened a first support for said first container, said first support comprising a pair of legs;

c) a second hinge attached to said container and to which is fastened a second support for said container, said second support comprising a pair of legs;

d) said hinges permitting said pairs of legs to pivot about 180° with respect to said container so that said supports can be pivoted between two orientations about 180° apart, said hinges being located adjacent said opening;

e) whereby in a first orientation of said pairs of legs, said container may be supported by said pairs of legs with said opening facing upward a first distance above a ground surface, and in a second orientation of said pairs of legs said container may be supported by said supports with said opening facing downward a second distance above said ground surface, said second distance being greater than said first distance;

f) wherein in said second orientation, said bottom of said container faces upward, and further including a peripheral wall surrounding said bottom, said peripheral wall extending upwardly in said second orientation and forming a recessed area with said bottom; and g) said system comprising a second container having a bottom and side walls surrounding a chamber having an opening opposite said bottom, said second container being sized so that its bottom and adjacent portions of its side walls are receivable within said recessed area in said second orientation of said first container.

15. The system of claim 14, wherein each leg has an adjustable length, including at least two leg sections that telescope to adjust length.

16. The system of claim 14, further including a cross member connected between respective pairs of legs of each support.

17. The system of claim 16, further including an elastic cord releasably connectable between said cross members in each orientation of said supports to retain said supports in each orientation, said cord including a hook at each end thereof.

18. The system of claim 14, further including a strap releasably attachable to said first container.

* * * * *